US005322210A

United States Patent [19]

Chila et al.

[11] Patent Number: 5,322,210

[45] Date of Patent: Jun. 21, 1994

[54] DISPLAY BOX

[76] Inventors: J. Paul Chila; Peter P. Erickson, 46 Pleasant St., both of, Marlboro, Mass. 01752

[21] Appl. No.: 13,031

[22] Filed: Feb. 3, 1993

[51] Int. Cl.[5] ..... B65D 85/30

[52] U.S. Cl. ..... 229/8; 206/44 R; 206/315.9; 206/521.2; 206/521.6; 206/588

[58] Field of Search ..... 229/8, 40; 206/44 R, 206/45.14, 315.9, 418, 521.2, 521.6, 521.8, 521.9, 588

[56] References Cited

U.S. PATENT DOCUMENTS

| | | | |
|---|---|---|---|
| 1,650,337 | 11/1927 | Fletcher | 206/521.2 |
| 2,833,074 | 5/1958 | Jannes | 229/8 |
| 3,363,747 | 1/1968 | Nowak | 229/8 |
| 4,779,726 | 10/1988 | Pratt | 229/40 |
| 4,856,706 | 8/1989 | Van Der Straten | 229/8 |

FOREIGN PATENT DOCUMENTS

| | | | |
|---|---|---|---|
| 153747 | 7/1952 | Australia | 206/418 |
| 518828 | 3/1940 | United Kingdom | 206/418 |
| 696396 | 8/1953 | United Kingdom | 206/418 |
| 755722 | 8/1956 | United Kingdom | 229/8 |
| 785227 | 10/1957 | United Kingdom | 206/418 |
| 966033 | 8/1964 | United Kingdom | 229/8 |
| 968312 | 9/1964 | United Kingdom | 206/418 |
| 733036 | 7/1966 | United Kingdom | 229/8 |

*Primary Examiner*—Gary E. Elkins
*Attorney, Agent, or Firm*—Blodgett & Blodgett

[57] ABSTRACT

A display box for protectively packaging contents is disclosed. When the display box is in the closed position, the contents are retained by at least one depression or aperture in the forward wall of at least one right triangular prism that comprises the display box. When in the open position, the display box is self-supporting, has several surfaces for displaying information or decoration, and is designed to be displayed with the contents. Each of the right triangular prisms is hingedly fastened at its back edges to at least one adjacent right triangular prism so that all of the right triangular prisms are fastened in series and are moveable between a first open position and a second closed position. In the first open position, the back planar surfaces of the right triangular prisms are co-planar. In the second closed position, the vertex edge of each right triangular prism lies along a central vertical longitudinal axis of the display box. In the preferred embodiment, there are four right triangular prisms which are hollow and the depression is an aperture allowing the viewing of at least a part of an inside surface of the back planar wall. The preferred embodiment is further formed of flexible sheet material which is a single contiguous piece. In an alternate embodiment, the right triangular prisms are solid, and have a depression.

19 Claims, 5 Drawing Sheets

FIG. 8
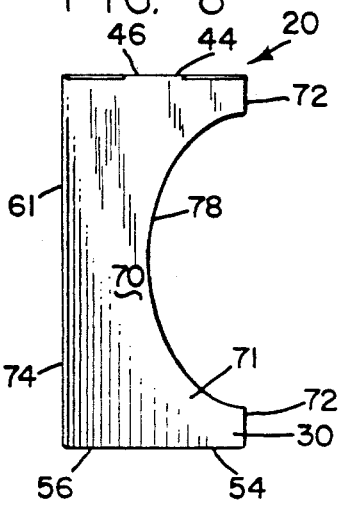
FIG. 9
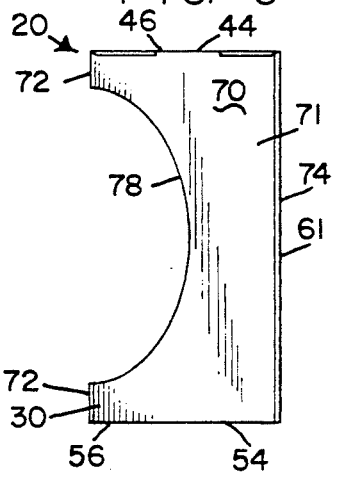
FIG. 10
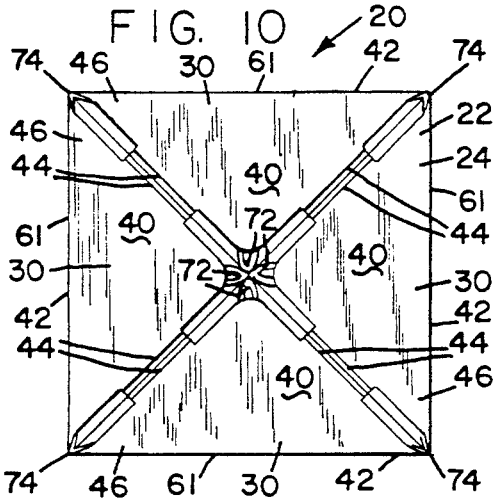
FIG. 11
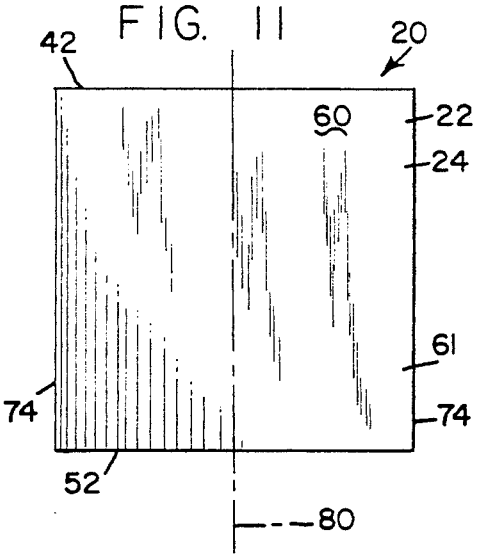
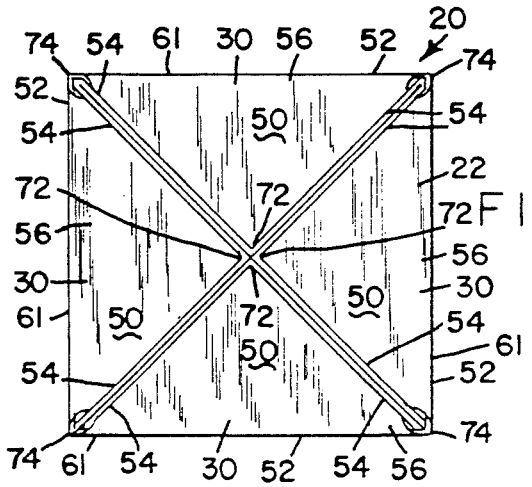
FIG. 12

DISPLAY BOX

BACKGROUND OF THE INVENTION

The field of invention relates generally to display packaging, and more particularly, pertains to display packaging which is to be retained and utilized with the contents. The field of packaging includes prior art that is designed to provide safe transport for a product. This has been accomplished through durability of the packaging itself, or else additional partitions or inserts designed to cushion the contents. Both the external packaging, and the internal partitions or inserts are typically discarded after the package is transported and the contents removed. This waste, in recent years, has placed a severe strain on sanitary landfills and on our disposal systems. Such is especially the case when the packaging materials are not constructed of biodegradable substances.

In the packaging industry, emphasis has also been placed on packaging which is designed to enhance the attractiveness of the goods while the goods are in the package. This is particularly true in the case of consumer goods. Product enhancement is accomplished by packaging that either allows for the viewing of all or part of the contents while packaged, or else packaging that is appealing in its own right. On occasion, it is accomplished through packaging that creates the impression that the contents are larger than what is actually the case. Even in the context of decorative packaging, the packaging is designed to be discarded immediately after removal of the contents. This occurs in almost all instances of consumer packaging. Many times the disposal of the packaging is virtually assured by the fact that it is necessary to destroy or damage the packaging in order to obtain access to the contents.

In the separate field of display booths or table top displays, the emphasis is on the provision of a lightweight, but structurally sound construction that will permit the mounting of various advertising signs, literature, or samples. Sometimes these structures are designed for reuse, but often they are intended to have only a single use. This again creates the disposal problems that were mentioned above. In addition, these display structures are meant to advertise the aspects of a product only. They are not meant to be a container for the product for transport and protection.

The present invention is intended to consolidate the advantageous features that exist in both the area of packaging and the area of display booths or table top displays in a novel combination, while overcoming the problems.

These and other difficulties experienced with the prior art packaging, display booths and table top displays have been obviated in a novel manner by the present invention.

It is, therefore, a principal object of the invention to provide a display box that will provide protection for the contents during shipment and storage.

Another object of this invention is the provision of a display box that will avoid waste in packaging, by utilizing the packaging after shipping, and causing a decrease in the volume of disposed material.

A further object of the present invention is the provision of a display box that is constructed from biodegradable material.

It is another object of the instant invention to provide a display box that may be easily opened without damage to the packaging or the contents.

A still further object of the invention is the provision of a display box that when in the closed position will provide a uniform, symmetrical, package which is conducive to packaging a quantity of display boxes in a larger package, or for stacking in a storage facility.

It is a further object of the present invention to provide a display box that will be lightweight to reduce shipping costs.

It is a still further object of the present invention to provide a display box with a plurality of flat surfaces to allow for the imprinting of commercial messages or ornamentation.

Another object of the invention is the provision of a display box that, when in the open position, will be self-supporting, to allow for the viewing of the package itself.

A further object of the invention is the provision of a display box that will enhance the theme of the contents when viewed together with those contents.

It is another object of the instant invention to provide a display box that will allow for observation from an external vantage point of at least a portion of the internal surface.

With these and other objects in view, as will be apparent to those skilled in the art, the invention resides in the combination of parts set forth in the specification and covered by the claims appended hereto.

SUMMARY OF THE INVENTION

A display box for packaging contents in a protected manner when the display box is in a closed position. When the display box is in the closed position, the contents are retained by at least one depression or aperture in the forward wall of at least one right triangular prism that comprises the display box.

When in the open position, the display box is self-supporting and has a plurality of surfaces for displaying either commercial information or decorative ornamentation. The display box is designed to be displayed with the contents.

When in a closed position, the outer surface of the display box forms the shape of a right prism. The display box comprises at least three right triangular prisms.

Each of the right triangular prisms has a top triangular planar surface and a bottom triangular planar surface, the top triangular planar surface and the bottom triangular planar surface lying in spaced parallel planes. Each of the triangular planar surfaces has a base and two sides.

Each of the right triangular prisms further has a rectangular back planar surface intersecting the triangular planar surfaces at a right angle along the base of each of said triangular planar surfaces.

In addition, each of the right triangular prisms has two rectangular front planar surfaces, each front planar surface intersecting the triangular planar surfaces at a right angle along the corresponding side of each of the triangular planar surfaces, said front planar surfaces also intersecting each other to form a vertex edge, and each of said front planar surfaces further intersecting the back planar surface to form a back edge.

A portion of at least one front planar surface of at least one right triangular prism has a depression.

Each of the right triangular prisms is hingedly fastened fit its back edges to at least one adjacent right triangular prism so that all of the right triangular prisms are fastened in series and are moveable between a first open position and a second closed position. In the first open position, the back planar surfaces of the right triangular prisms are co-planar. In the second closed position, the vertex edge of each right triangular prism lies along a central vertical longitudinal axis of the display box, and each front planar surface of each right triangular prism is parallel to and abuts the front planar surface of the adjacent right triangular prism. In the second closed position, the back planar surfaces of the right triangular prisms form the side surfaces of the right prism of the display box.

In the preferred embodiment, there are four right triangular prisms which are hollow, and the top triangular planar surface, the bottom triangular planar surface, the rectangular back planar surface and the rectangular front planar surfaces are formed from a top triangular planar wall, a bottom triangular planar wall, a rectangular back planar wall and rectangular front planar walls, respectively. In this preferred embodiment, the depression is an aperture, the aperture allowing the viewing of at least a part of an inside surface of the back planar wall. All of the right triangular prisms have an aperture.

The preferred embodiment is further formed of flexible sheet material which is a single contiguous piece.

In an alternate embodiment, the right triangular prisms are solid, and have a depression.

As can be seen, the display box provides for the protection of the contents during shipping, while retention of the packaging material for display purposes reduces the amount of waste material disposed into the environment. The biodegradable material which is employed further augments this benefit. In addition, the ability to easily open the display box without damaging the display box itself or the contents avoids the need to dispose of the packaging due to damage.

In the closed position, the display box assumes a shape that lends itself to either repackaging in multiple units, or stacking in a storage facility. Being of lightweight construction, the display box allows for reduced shipping costs.

In regards to its display attributes, the display box comprises a plurality of flat surfaces that may be conveniently used for the imprinting of commercial messages or ornamentation. In its open position, it is self-supporting to allow for the convenient viewing of the messages or ornamentation. The construction of the display box further allows for the viewing of at least a portion of the internal surfaces, from an external vantage point. In this manner, the display box can be put on display with the contents to enhance the theme of the contents.

BRIEF DESCRIPTION OF THE DRAWINGS

The character of the invention, however, may be best understood by reference to one of its structural forms, as illustrated by the accompanying drawings, in which:

FIG. 8 is a side elevational view, as seen from the left, of the display box of FIG. 4, shown in a first open position, FIG. 9 is a side elevational view, as seen from the right, of the display box of FIG. 4, shown in a first open position, FIG. 10 is a top plan view of the display box of FIG. 4, shown in a second closed position, FIG. 11 is an elevational view of the display box of FIG. 4, shown in a second closed position, and as seen from either the left side, the right side, the front or the back, FIG. 12 is a bottom plan view of the display box of FIG. 4, shown in a second closed position.

DESCRIPTION OF THE PREFERRED EMBODIMENT

Figure 1:
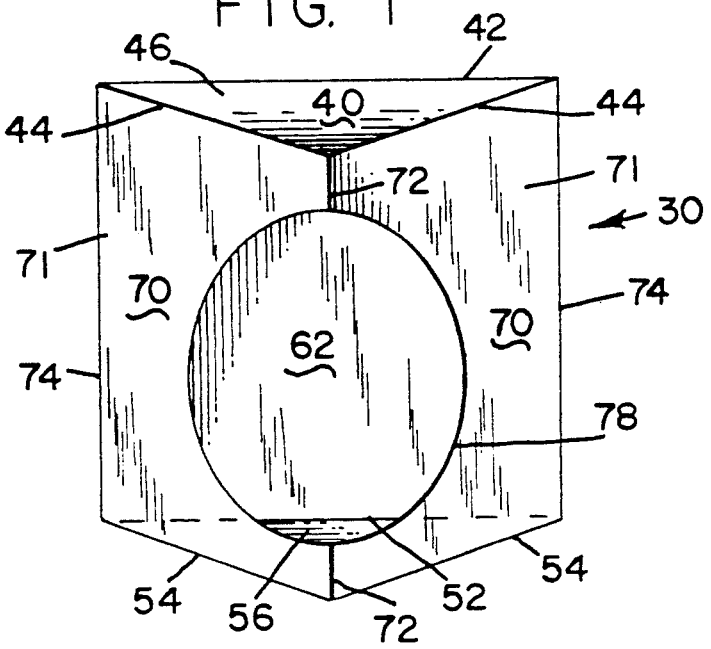
FIG. 1 is a perspective view, as seen from above and in front, of a portion of the display box of FIG. 4, broken away at a back edge to show one of the right triangular prisms, with detailing omitted to emphasize the geometric structure.

Prior to referring to the drawings, definitions are offered to assist the reader in an understanding of this description.

A "prism" is a polyhedron having two surfaces that are polygons in parallel planes, while the other surfaces are parallelograms.

A "right prism" is a prism whose side surfaces are rectangular.

A "right triangular prism" is a right prism in which the polygons lying in parallel planes are triangles.

A "vertex" is the point opposite to and farthest from the base in any figure having a base.

A "vertex edge" is the edge that is opposite to and farthest from the base in any three dimensional figure having a base.

Figure 2:
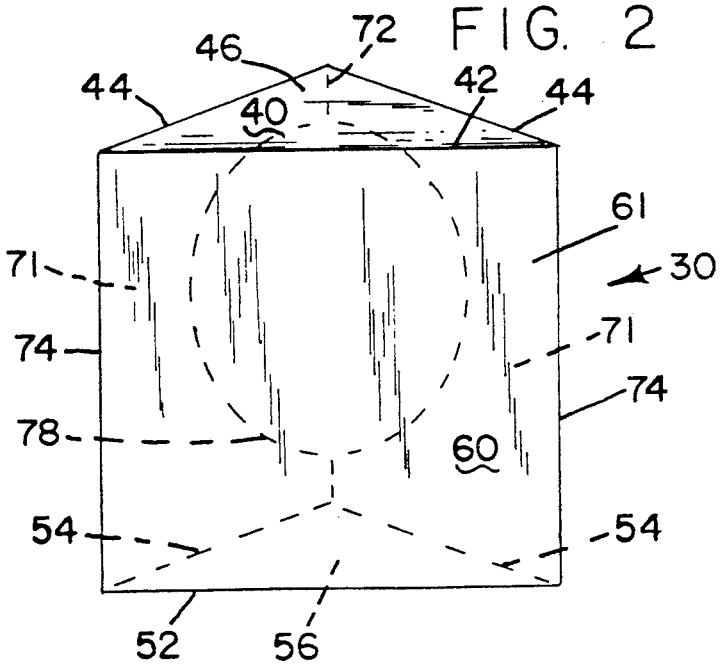
FIG. 2 is a perspective view, as seen from above and from behind of the right triangular prism of FIG. 1, with detailing omitted to emphasize the geometric structure.
Figure 4:
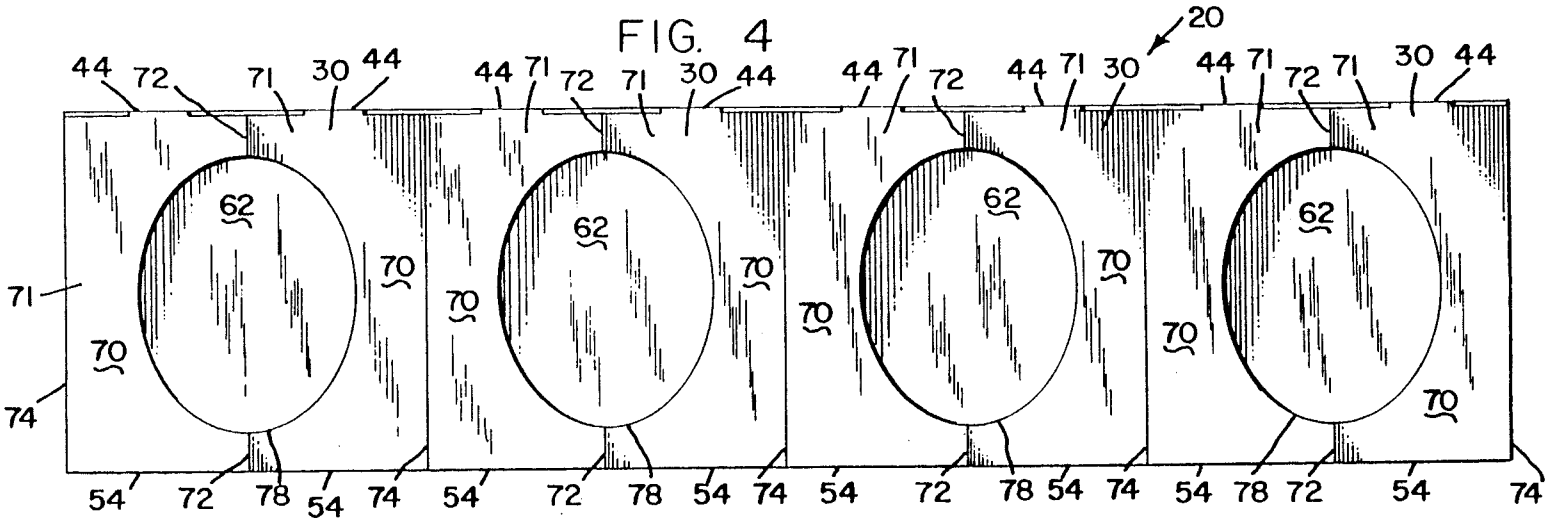
FIG. 4 is a front elevational view of a display box, embodying the principals of the present invention, and shown in a first open position.
Figure 5:
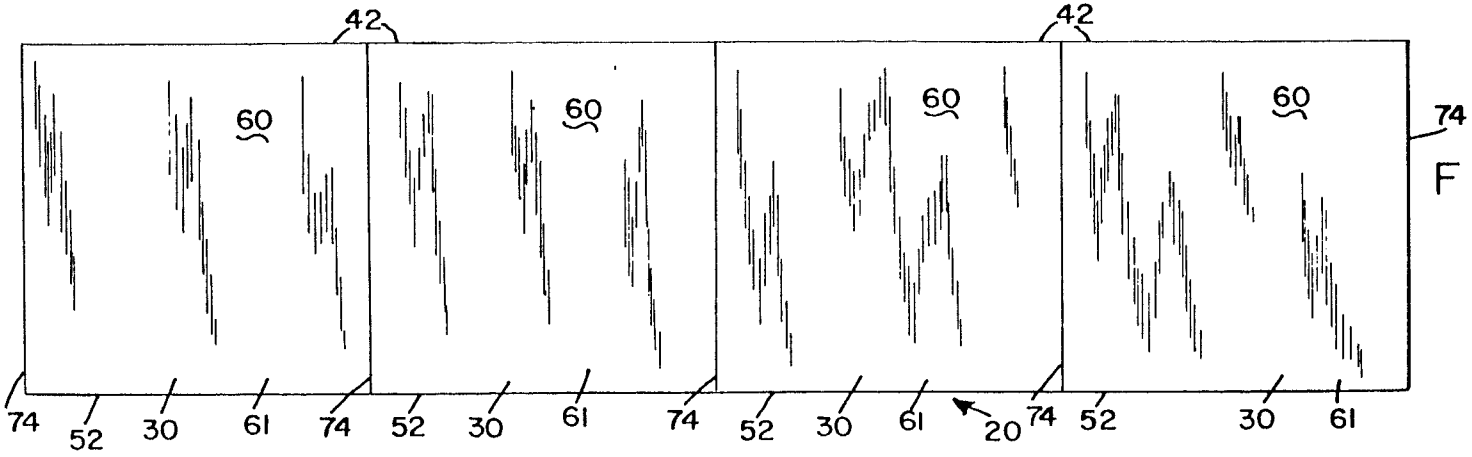
FIG. 5 is a rear elevational view of the display box of FIG. 4, shown in a first open position.
Figure 6:
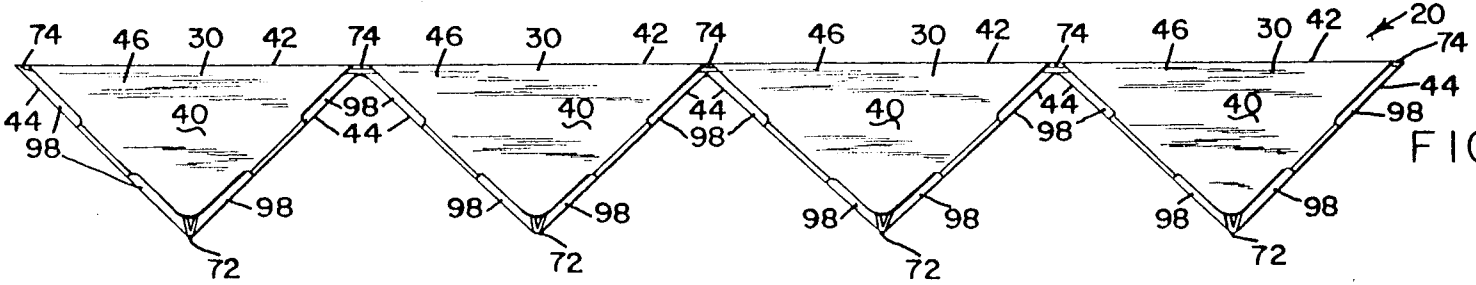
FIG. 6 is a top plan view of the display box of FIG. 4, shown in a first open position.
Figure 7:
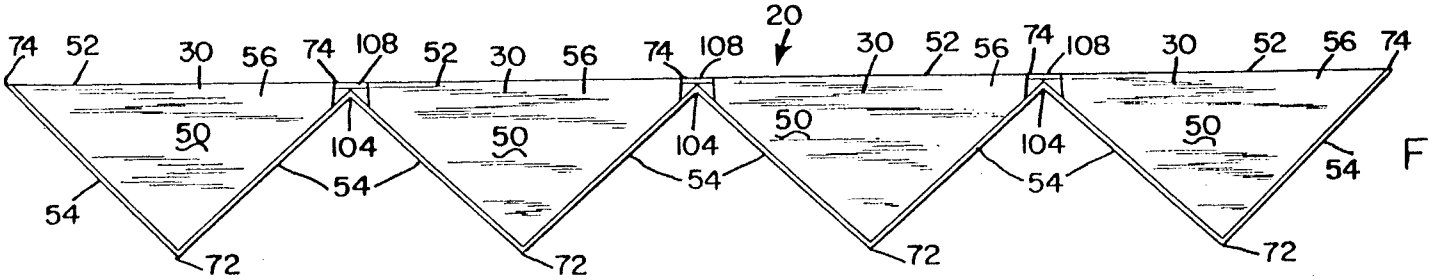
FIG. 7 is a bottom plan view of the display box of FIG. 4, shown in a first open position.

With reference now to the drawings, there is shown in FIGS. 1 and 2, a right triangular prism 30 which is a portion of the display box 20 of FIG. 4, broken away at a back edge 74 and with detailing omitted to emphasize the geometric structure.

The right triangular prism 30 has a top triangular planar surface 40 and a bottom triangular planar surface 50. The top triangular planar surface 40 and the bottom triangular planar surface 50 lie in spaced parallel planes. The top triangular planar surface 40 has a base 42 and two sides 44. Similarly, the bottom triangular planar surface 50 has a base 52 and two sides 54.

The right triangular prism 30 further has a rectangular back planar surface 60 intersecting the top triangular planar surface 40 at a right angle along the base 42 of the top triangular planar surface 40. The rectangular back planar surface 60 also intersects the bottom triangular planar surface 50 at a right angle along the base 52 of the bottom triangular planar surface 50.

The right triangular prism 30 also has two rectangular front planar surfaces 70. Each rectangular front planar surface 70 intersects the top triangular planar surface 40 at a right angle along the corresponding sides 44 of the top triangular planar surface 40. Each rectangular front planar surface 70 also intersects the bottom triangular planar surface 50 at a right angle and along the corresponding sides 54 of the bottom triangular planar surface 50.

The rectangular front planar surfaces 70 also intersect each other to form a vertex edge 72. Each of the rectangular front planar surfaces 70 further intersects the rectangular back planar surface 60 to form a back edge 74.

A portion of at least one rectangular front planar surface 70 of at least one right triangular prism 30 has a depression 76 in the form of an aperture 78.

Referring next to FIGS. 4–9, there is shown the invention of the display box 20, comprised of four right triangular prisms 30, and configured in an open position. Each of the right triangular prisms 30 is hingedly fastened at its back edges 74 to at least one adjacent right triangular prism 30. All of the right triangular prisms 30 are fastened in series, and are moveable between a first open position and a second closed position. In the first open position, the rectangular back planar surfaces 60 of the right triangular prisms 30 are co-planar.

Referring to FIGS. 10–12, the display box 20 can be seen in the second closed position. In the second closed position, the vertex edge 72 of each right triangular prism 30 lies along a central vertical longitudinal axis 80 of the display box 20. In this second closed position, each rectangular front planar surface 70 of each right triangular prism 30 is parallel to and abutting the rectangular front planar surface 70 of the adjacent right triangular prism 30.

The display box 20, when in the second closed position, has an overall outer surface 22 in the shape of a right prism 24. In this second closed position, it can also be noted that the rectangular back planar surfaces 60 of the right triangular prisms 30 form the side surfaces 26 of the right prism 24 of the display box 20.

In this preferred embodiment, the right triangular prisms 30 are hollow. As such, the top triangular planar surface 40, the bottom triangular planar surface 50, the rectangular back planar surface 60 and the rectangular front planar surfaces 70 are formed from a top triangular planar wall 46, a bottom triangular planar wall 56, a rectangular back planar wall 61 and rectangular front planar walls 71, respectively. In this embodiment with hollow right triangular prisms 30, the depression 76 is in the form of an aperture 78. The aperture 78 allows for the viewing of at least a part of an inside surface 62 of the rectangular back planar wall 61. All of the right triangular prisms 30 of the display box 20 have an aperture 78.

Figure 3:
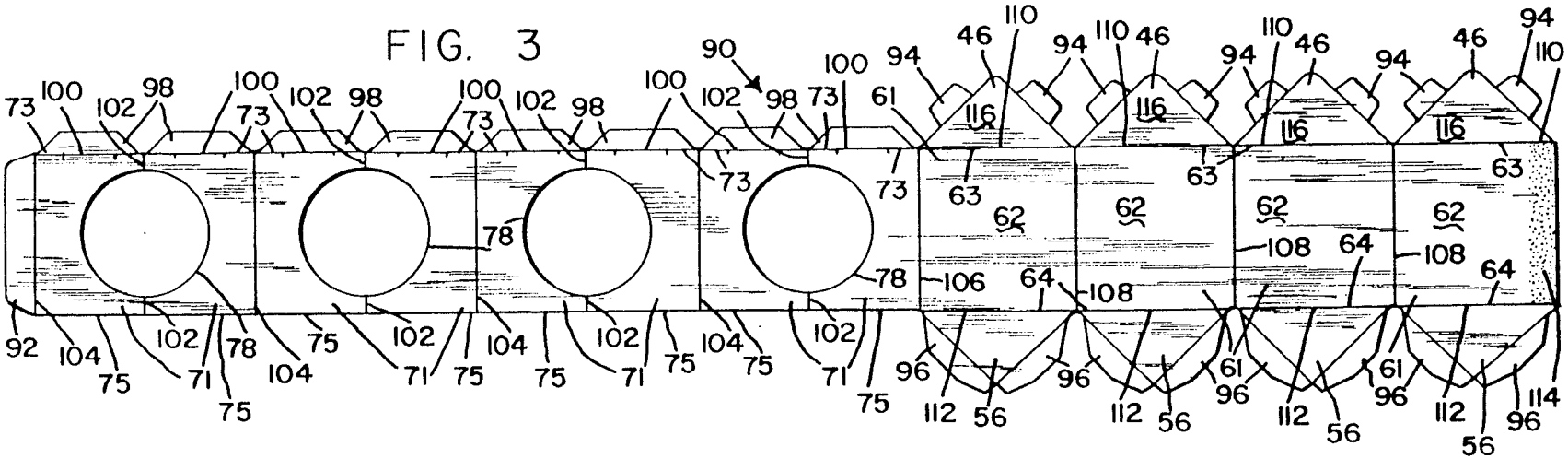
FIG. 3 is a diagram of the blank from which the display box is formed.

With reference to FIG. 3, a further aspect of the preferred embodiment is that the display box 20 is formed from flexible sheet material that is a single contiguous piece shown as a blank 90. The blank 90 is shown with the top triangular planar surfaces 40, the bottom triangular planar surfaces 50, the rectangular back planar surfaces 60 and the rectangular front planar surfaces 70 all facing away from the viewer.

In the blank 90, the rectangular front planar walls 71 are arranged in series, with the two rectangular front planar walls 71 belonging to any one right triangular prism 30, being separated from each other by a vertex edge fold line 102. The rectangular front planar walls 71 belonging to any one right triangular prism 30 are separated from the rectangular front planar walls 71 belonging to adjacent right triangular prisms 30 by a back edge fold line 104. Each rectangular front planar wall 71 carries a slotted tab 98 at its upper edge 73. Each slotted tab 98 carries a slot 100 at the upper edge 73 of the rectangular front planar wall 71.

Also in the blank 90, the rectangular back planar walls 61 are arranged in series, and separated from the rectangular front planar walls 71 by a main back edge fold line 106. Each rectangular back planar wall 61 is separated from its adjacent rectangular back planar walls 61 by a back edge fold line 108.

An upper edge 63 of the rectangular back planar wall 61 carries a top triangular planar wall 46. The base 42 of the top triangular planar surface 40 and the upper edge 63 of the rectangular back planar wall 61 are collinear and coextensive. The rectangular back planar wall 61 and the top triangular planar wall 46 are separated by a top triangular wall fold line 110. Each top triangular planar wall 46 carries a slot tab 94 at each of the two sides 44 of the top triangular planar surface 40.

A lower edge 64 of the rectangular back planar wall 61 carries a bottom triangular planar wall 56. The base 52 of the bottom triangular planar surface 50 and the lower edge 64 of the rectangular back planar wall 61 are collinear and coextensive. The rectangular back planar wall 61 and the bottom triangular planar wall 56 are separated by a bottom triangular wall fold line 112. Each bottom triangular planar wall 56 carries a glue tab 96 at each of the two sides 54 of the bottom triangular planar surface 50.

It should be noted that the blank 90 may be equivalently constructed with slotted tabs 98 also being carried at the lower edges 75 of the rectangular front planar walls 71, as well as being carried at their present position at the upper edges 73 of the rectangular front planar walls 71. In that instance, the glue tabs 96 would be replaced with slot tabs 94. Similarly, the glue tabs 96 may also be carried in like manner by the top triangular planar walls 46, as well as being carried by the bottom triangular planar walls 56. In such instance, the slotted tabs 98 would not appear at the upper edges 73 of the rectangular front planar walls 71. Finally, the current configuration could be constructed in a reverse manner with the top triangular planar walls 46 carrying the glue tabs 96 and the bottom triangular planar walls 56 carrying the slot tabs 94. In this instance, the slotted tabs 98 would appear on the lower edges 75 of the rectangular front planar walls 71. All such configurations of slotted tabs 98. glue tabs 96, and slot tabs 94 are equivalent.

The left most portion of the blank 90 carries a main tab 92 on a rectangular front planar wall 71. The right most portion of the blank 90 carries a contact glue area 114 for the main tab 92. Each of the top triangular planar walls 46 have an inside surface 116.

The invention having been thus described, the operation will now be clear to those of ordinary skill in the art as described below.

Referring to FIG. 3, the blank 90 is constructed by rotating the rectangular front planar walls 71, as a group, from left to right about the main back edge fold line 106 until each pair of rectangular front planar walls 71 is above a corresponding rectangular back planar wall 61. Main tab 92 is bent downward so that the back surface (not shown) of main tab 92 abuts with contact glue area 114. Main tab 92 is then fastened to contact glue area 114 with a suitable adhesive.

Each back edge fold line 104 on the front planar walls 71 is aligned with, and placed above, a back edge fold line 108 on the rectangular back planar walls 61. This is accomplished by bending the rectangular front planar walls 71 at the vertex edge fold lines 102 and lifting the vertex edge fold lines 102 slightly away from the rectangular back planar walls 61.

Glue tabs 96 are bent upward at right angles with respect to the bottom triangular planar walls 56. The bottom triangular planar walls 56 are then bent upward at right angles with respect to the rectangular back planar walls 61, and along the bottom triangular wall fold lines 112. The back surface of the glue tabs 96 (not shown) are then fastened to the rectangular front planar walls 71, near the lower edges 75 of the rectangular front planar walls 71, with a suitable adhesive.

Similarly, slot tabs 94 are bent upward at right angles with respect to the top triangular planar walls 46. The top triangular planar walls 46 are then bent upward at right angles with respect to the rectangular back planar walls 61, and along the top triangular wall fold lines 110. The slot tabs 94 are then inserted into the slots 100 of the slotted tabs 98. After this insertion, the inside surfaces 116 of the top triangular planar walls 46 rest upon the back surfaces (not shown) of the slotted tabs 98.

The display box 20, having been constructed as such from the blank 90, it becomes apparent that the back edge fold lines 104 on the rectangular front planar walls 71, combine with the back edge fold lines 108 of the rectangular back planar wall 61 to form the back edges 74. Main back edge fold line 106 also serves to form a back edge 74. The fastening of the back edge fold line 104 on the rectangular front planar wall 71 that is adjacent to the main tab 92, to the rectangular back planar wall 61 that bears the contact glue area 114, forms still another back edge 74. The vertex edge fold lines 102 form the vertex edges 72.

With the display box 20 in the first open position, an object (not shown) is then placed partly through one of the apertures 78. The right triangular prisms 30 of the display box 20 are then rotated about their back edges 74 until the display box 20 assumes the second closed position as described above. The display box is secured in the closed position using an appropriate adhesive or fastener. This serves to fully enclose the object (not shown) within the display box 20.

Figure 14:
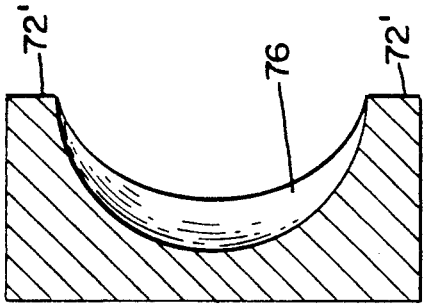
FIG. 14 is a vertical cross sectional view of the right triangular prism of FIG. 13, taken along the line 14—14 thereof, and looking in the direction of the arrows.
Figure 13:
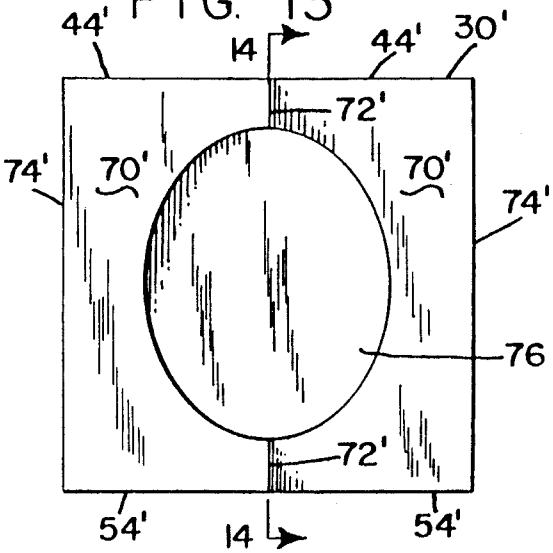
FIG. 13 is a front elevational view of a portion of a second embodiment of a display box, embodying the principals of the present invention, broken away at a back edge to show one of the right triangular prisms, with detailing omitted to emphasize the geometric structure.

Referring to FIGS. 13 and 14, a second embodiment of the invention is identical to the preferred embodiment with the exceptions that the right triangular prisms indicated generally by the reference numeral 30' are solid and that more than one right triangular prism 30' have a depression 76. In all instances, elements having numbers with a prime, correspond to the same element having a number without a prime in the preferred embodiment.

Figure 15:
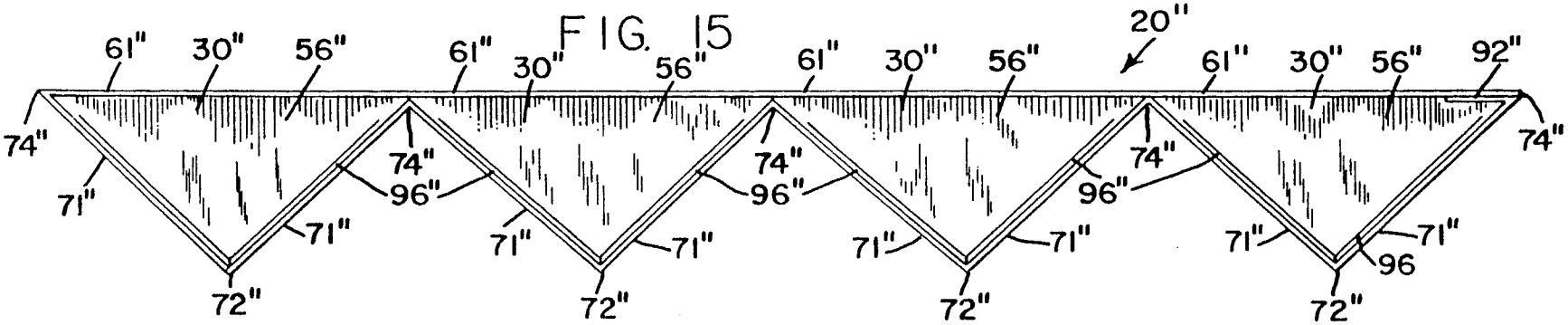
FIG. 15 is a top plan view of a third embodiment of a display box, embodying the principals of the present invention, and shown in a first open position.

Referring to FIG. 15, a third embodiment of the invention, indicated generally by the reference numeral 20" is identical to the preferred embodiment with the exception that each of the right triangular prisms indicated generally by the reference numeral 30" has only a top triangular planar wall 46" or only a bottom triangular planar wall 56", but not both in the same right triangular prism 30". In all instances, elements having numbers with a prime, correspond to the same element having a number without a prime in the preferred embodiment.

The hollow embodiments of the display box 20 can be constructed of any flexible sheet material such as cardboard, a thermoplastic polymer or any similar material. Additionally, the hollow embodiments of the display box 20 could be constructed of a rigid material such as ceramic, crystal, acrylic, or other suitable material. Further, the hollow embodiments of the display box 20 could be constructed of a rigid framework with either a rigid or flexible material supported by the framework.

The solid embodiment of the display box can be constructed of any material such as a thermoplastic polymer, ceramic, crystal, acrylic, glass, wood, or any other appropriate material.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A display box which has an open position and a closed position, said display box having an outer surface which defines a right prism which has a central vertical longitudinal axis when said box is in said closed position, said display box comprising:

(a) at least three right triangular prisms, each of said right triangular prisms having:

(1) a horizontal triangular top planar surface and a horizontal triangular bottom planar surfaces which is vertically aligned with and spaced from said top planar surface, each of said top and bottom planar surfaces having a horizontal base edge, a horizontal right side edge and a horizontal left side edge, (2) a vertical rectangular back planar surface which extends from the base edge of said top planar surface to the base edge of said bottom planar surface, said back planar surface having a vertical right side edge and a vertical left side edge, (3) a vertical rectangular first front planar surface which extends from the horizontal right side edge of said top planar surface to the right side edge of said bottom planar surface, said first front planar surface having a vertical front edge and a vertical back edge, said back edge intersecting the vertical right side edge of said back planar surface to form a right back vertex edge, (4) a vertical rectangular second front planar surface which extends from the left side edge of said top planar surface to the left side edge of said bottom planar surface, said second front planar surface having a front edge which intersects the front edge of said first front planar surface to form a vertical front vertex edge, said second front planar surface having a vertical back edge which intersects the left side edge of said back planar surface to form a vertical left back vertex edge, (b) a portion of at least one of said first and second front planar surfaces of at least one of said right triangular prisms having a depression; and (c) each of said right triangular prisms being hingedly fastened at at least one of its back vertex edges to one of the back vertex edges of at least one other of said right triangular prisms wherein all of the right triangular prisms are hingedly fastened in series so that when said display box is in said open position, the back planar surfaces of said right triangular prisms are co-planar, and when the display box is in said closed position, the front vertex edge of each right triangular prism lies along the central vertical longitudinal axis of said right prism, each of said first and second front planar surfaces of each of said right triangular prisms is parallel to and abuts one of said first and second front planar surfaces of another one of said right triangular prisms within the right prism of said box and the top bottom and back planar surfaces of the right triangular prisms form the outer surface of said display box which defines said right prism.

2. The display box of claim 1, wherein the right triangular prisms are hollow, and wherein said display box comprises:

(a) a horizontal top triangular planar wall which contains said horizontal top triangular planar surface;

(b) a horizontal bottom triangular planar wall which contains said horizontal bottom triangular planar surface;

(c) a vertical rectangular back planar wall which contains said vertical rectangular back planar surface, said back planar wall having a forwardly facing front surface;

(d) a vertical rectangular first front planar wall which contains said vertical rectangular first planar surface; and (e) a vertical rectangular first front planar wall which contains said vertical rectangular second planar surface, said depression being an aperture in one of said first and second front planar walls so that at least part of the front surface of said back planar wall is visible from a point in front of the right triangular prism when said display box is in the open position.

3. The display box of claim 2, wherein the display box is formed of flexible sheet material.

4. The display box of claim 3, wherein the flexible sheet material forming the display box is a single contiguous piece.

5. The display box of claim 4, wherein the at least three right triangular prisms include four right triangular prisms.

6. The display box of claim 5, wherein more than one of said right triangular prisms have an aperture.

7. The display box of claim 6, wherein all of the right triangular prisms have an aperture.

8. The display box of claim 3, wherein the at least three right triangular prisms include four right triangular prisms.

9. The display box of claim 2, wherein the at least three right triangular four right triangular prisms.

10. The display box of claim 2, wherein more than one right triangular prism have an aperture.

11. The display box of claim 10, wherein all of the right triangular prisms have an aperture.

12. The display box of claim 11, wherein the right triangular prisms are solid.

13. The display box of claim 12, wherein the at least three right triangular prisms include four right triangular prisms.

14. The display box of claim 12, wherein more than one right triangular prism have a depression.

15. The display box of claim 14, wherein all of the right triangular prisms have a depression.

16. A display box which has an open position and a closed position, said box having an outer surface which has the shape of a right prism which has a central vertical longitudinal axis when the box is in said closed position, said display box comprising:

(a) at least three right triangular prisms, each of said right triangular prisms comprising:

(1) a rectangular vertical back wall which has a back surface, a front surface, a horizontal top edge, a horizontal bottom edge, a vertical left side edge and a vertical right side edge;

(2) a triangular horizontal top wall which has a top surface, a horizontal left side edge, a horizontal right side edge and a horizontal back edge which intersects the top edge of said back wall;

(3) a triangular horizontal bottom wall which has a bottom surface, a horizontal left side edge, a horizontal right side edge and a horizontal back edge which intersects the bottom edge of the back wall; and (4) a V-shaped vertical front wall which has a V-shaped front surface, a vertical front vertex edge which is spaced from said back wall, said front wall having a horizontal V-shaped top edge which intersects the left and right side edges of said top wall, a horizontal V-shaped bottom edge which intersects the left and right side edges of said bottom wall, a vertical left back edge which intersects the left edge of said back wall to form a left back vertex edge and a vertical right back edge which intersects the right side edge of said back wall to form a right back vertex edge, said front wall having an aperture so that at least part of the front surface of said back wall is visible from a point in front of the front wall, and (b) each of said right triangular prisms being hingedly fastened at at least one of its back vertex edges to one of said left and right back vertex edges of at least one other of said right triangular prisms, wherein all of the right triangular prisms are hingedly fastened in series so that when said display box is in said open position, the back surfaces of the back walls of said right triangular prisms are co-planar, and when the display box is in said closed position, the front vertex edge of each right triangular prism lies along the central vertical longitudinal axis of the right prism of said display box, the front surface of the front wall of each right triangular prism is parallel to and abuts a front surface of the front wall of another one of said right triangular prisms within the right prism of said box, and wherein the top surface of said top walls, the bottom surfaces of said bottom walls, the back surface of said back walls, and the front surfaces of said front walls form the outer surface of said display box.

17. The display box of claim 16, wherein the display box is formed of flexible sheet material.

18. The display box of claim 17, wherein the flexible sheet material forming the display box is a single contiguous piece.

19. The display box of claim 18, wherein at least three right triangular prisms include four right triangular prisms.

* * * * *